US010395599B2

(12) United States Patent
Noh et al.

(10) Patent No.: US 10,395,599 B2
(45) Date of Patent: Aug. 27, 2019

(54) DISPLAY DEVICE

(71) Applicant: Samsung Display Co., Ltd., Yongin-si, Gyeonggi-do (KR)

(72) Inventors: Jae-Du Noh, Mokpo-si (KR); Sang-Won Seok, Gwangmyeong-si (KR); Hwan-Soo Jang, Asan-si (KR); Jin-Tae Jeong, Suwon-si (KR); Seung-Yeon Cho, Seoul (KR); Ji-Hyun Ka, Asan-si (KR)

(73) Assignee: Samsung Display Co., Ltd. (KR)

( * ) Notice: Subject to any disclaimer, the term of this patent is extended or adjusted under 35 U.S.C. 154(b) by 382 days.

(21) Appl. No.: 15/414,363

(22) Filed: Jan. 24, 2017

(65) Prior Publication Data

US 2017/0249906 A1 Aug. 31, 2017

(30) Foreign Application Priority Data

Feb. 29, 2016 (KR) ..... 10-2016-0024534
Oct. 20, 2016 (KR) ..... 10-2016-0136663

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/0286* (2013.01); *G09G 2310/08* (2013.01); *G09G 2320/0223* (2013.01); *G09G 2320/0233* (2013.01)

(58) Field of Classification Search
CPC ..... G09G 3/3266; G09G 3/3275; G09G 2310/0286; G09G 2320/0223; G09G 2320/0233; G09G 2310/08
See application file for complete search history.

(56) References Cited

U.S. PATENT DOCUMENTS

2008/0266210 A1* 10/2008 Nonaka ..... G09G 3/20 345/55
2015/0325593 A1* 11/2015 Shih ..... H01L 27/124 345/206

FOREIGN PATENT DOCUMENTS

KR 10-2005-0031645 A 4/2005
KR 10-2013-0092814 A 8/2013

* cited by examiner

*Primary Examiner* — Towfiq Elahi
(74) *Attorney, Agent, or Firm* — Innovation Counsil LLP

(57) ABSTRACT

A display device according to example embodiments includes a display panel divided into a first area including a plurality of first area pixel rows and a second area including a plurality of second area pixel rows, the number of pixels of each of the second area pixel rows being less than the number of pixels of each of the first area pixel rows, a scan driver configured to provide a plurality of scan signals to the display panel based on a width of an active period of a clock signal, the scan signals being output having substantially the same width of active periods to each other, a data driver configured to provide a plurality of data signals to the display panel, and a timing controller configured to adjust the width of the active period of the clock signal within a frame period based on locations of the first area and the second area.

20 Claims, 17 Drawing Sheets

DISPLAY DEVICE

CROSS REFERENCE TO RELATED APPLICATION

This application claims priority to and the benefit of Korean Patent Applications No. 10-2016-0024534, filed on Feb. 29, 2016, and No. 10-2016-0136663, filed on Oct. 20, 2016 in the Korean Intellectual Property Office (KIPO), the disclosures of which is hereby incorporated by references herein in its entirety.

BACKGROUND

1. Field

Example embodiments of the inventive concept relate to electronic devices. More particularly, example embodiments of the inventive concept relate to display devices having various display panel shapes.

2. Discussion of Related Art

A display device includes a plurality of pixels emitting light corresponding to data signals and a scan driver outputting scan signals to write the data signals to the pixels. A transition time (e.g., a rising time and/or a falling time) difference of output signals (e.g., scan signals) with respect to respective scan lines occurs due to a load difference with respect to the respective scan lines (or pixel rows). Particularly, the load difference may be significant when the display panel has an opening pattern (or a notch) or a shape of the display panel is not square. Accordingly, a width of an active period of the scan signal varies according to scan lines (or pixel rows), and thus, data writing time with respect to the pixel rows varies. For example, since a panel load (e.g., line resistances) of a first area including the opening pattern is relatively small compared with the other area of the display panel, rising and falling times of the scan signal corresponding to the first area is relatively shorter than the other area and the data writing time is relatively short. As a result, luminance of the first area including the opening pattern is less than the other area such that luminance uniformity of the display panel is decreased.

SUMMARY

Example embodiments provide a display device changing a clock pulse based on a load of a pixel row.

Example embodiments provide a display device changing a clock pulse based on a length of a pixel row.

According to example embodiments, a display device may comprise a display panel divided into a first area including a plurality of first area pixel rows and a second area including a plurality of second area pixel rows, the number of pixels of each of the second area pixel rows being less than the number of pixels of each of the first area pixel rows, a scan driver configured to provide a plurality of scan signals to the first area pixel rows and the second area pixel rows based on a width of an active period of a clock signal, the scan signals being output having substantially the same width of active period to each other, a data driver configured to provide a plurality of data signals to the display panel via a plurality of data lines, and a timing controller configured to adjust the width of the active period of the clock signal within a frame period based on locations of the first area and the second area.

In example embodiments, the timing controller may adjust the width of the active period of the clock signal based on the first area pixel rows and the second area pixel rows.

The width of the active period of the clock signal corresponding to a period that the scan signals are provided to the second area pixel rows may be less than the width of the active period of the clock signal corresponding to a period that the scan signals are provided to the first area pixel rows.

In example embodiments, the timing controller may adjust the width of the active period of the clock signal based on locations of the first area pixel rows and the second area pixel rows such that the widths of the active periods of the scan signals are substantially the same as each other.

In example embodiments, the number of pixels of at least one of the second area pixel rows may be different from the others of the second area pixel rows.

In example embodiments, the timing controller may adjust the width of the active period of the clock signal based on the number of pixels of each of the second area pixel rows.

In example embodiments, the width of the active period of the clock signal corresponding to a first pixel row of the second area pixel rows may be less than the width of the active period of the clock signal corresponding to a second pixel row of the second area pixel rows, when the number of pixels of the first pixel row is less than the number of pixels of the second pixel row.

In example embodiments, the numbers of the pixels of the second area pixel rows may be the same as each other.

In example embodiments, the width of the active period of the clock signal may be uniform while the scan signals are provided to the second area pixel rows.

In example embodiments, the second area of the display panel may include an opening pattern in which the pixels are not located.

In example embodiments, a length of the opening pattern in a first direction may be substantially uniform. The first direction may be substantially parallel to the second area pixel rows.

In example embodiments, the numbers of the pixels of the respective second area pixel rows may be the same as each other.

In example embodiments, the width of the active period of the clock signal may be uniform while the scan signals are provided to the second area pixel rows.

In example embodiments, the timing controller may adjust the width of the active period of the clock signal based on a change of a length of the opening pattern in a first direction while the scan signals are provided to the second area pixel rows, when the length of the opening pattern in the first direction is not uniform. The first direction may be substantially parallel to the second area pixel rows.

In example embodiments, the width of the active period of the clock signal may decrease when the length of the opening pattern in the first direction increases.

In example embodiments, the number of pixels of each of the second area pixel rows may decrease when the length of the opening pattern in the first direction increases.

According to example embodiments, a display device may comprise a display panel including a plurality of pixel rows each having a plurality of pixels, a scan driver configured to provide a plurality of scan signals to the pixel rows based on a width of an active period of a clock signal, the scan signals being output having substantially the same width of active periods to each other, a data driver configured to provide a plurality of data signals to the display panel via a plurality of data lines, and a timing controller configured to adjust the width of the active period of the clock signal within a frame period based on lengths of the respective pixel rows.

In example embodiments, the lengths of the respective pixel rows may be determined according to a shape of the display panel.

In example embodiments, the timing controller may shorten the width of the active period of the clock signal according to a decrease of a length of the pixel rows.

In example embodiments, the timing controller may adjust the width of the active period of the clock signal based on the number of pixels of each of the pixel rows.

In example embodiments, the display panel may include an opening pattern in which the pixels are not located.

Therefore, the display device according to example embodiments may include the display panel having various opening patterns and the pixel rows having various lengths, and adjust the width of the active period of the clock signal provided to the scan driver according to the lengths of the pixel rows (e.g., the number of pixels of each of the pixel rows). Accordingly, the plurality of scan signals having substantially the width of the active period may be output to the display panel regardless of the shape of the display panel and the lengths of the pixel rows. Thus, the data writing times for the pixels may be substantially uniform and data writing time uniformity and luminance uniformity of the display panel may be improved.

In addition, the display device according to example embodiments may include the display panel having various shapes, and adjust the width of the active period of the clock signal provided to the scan driver according to the lengths of the pixel rows. Thus, the luminance uniformity of the display panel may be improved.

BRIEF DESCRIPTION OF THE DRAWINGS

Example embodiments can be understood in more detail from the following description taken in conjunction with the accompanying drawings, in which.

DETAILED DESCRIPTION OF EMBODIMENTS

Exemplary embodiments will be described more fully hereinafter with reference to the accompanying drawings, in which various embodiments are shown.

Figure 1:
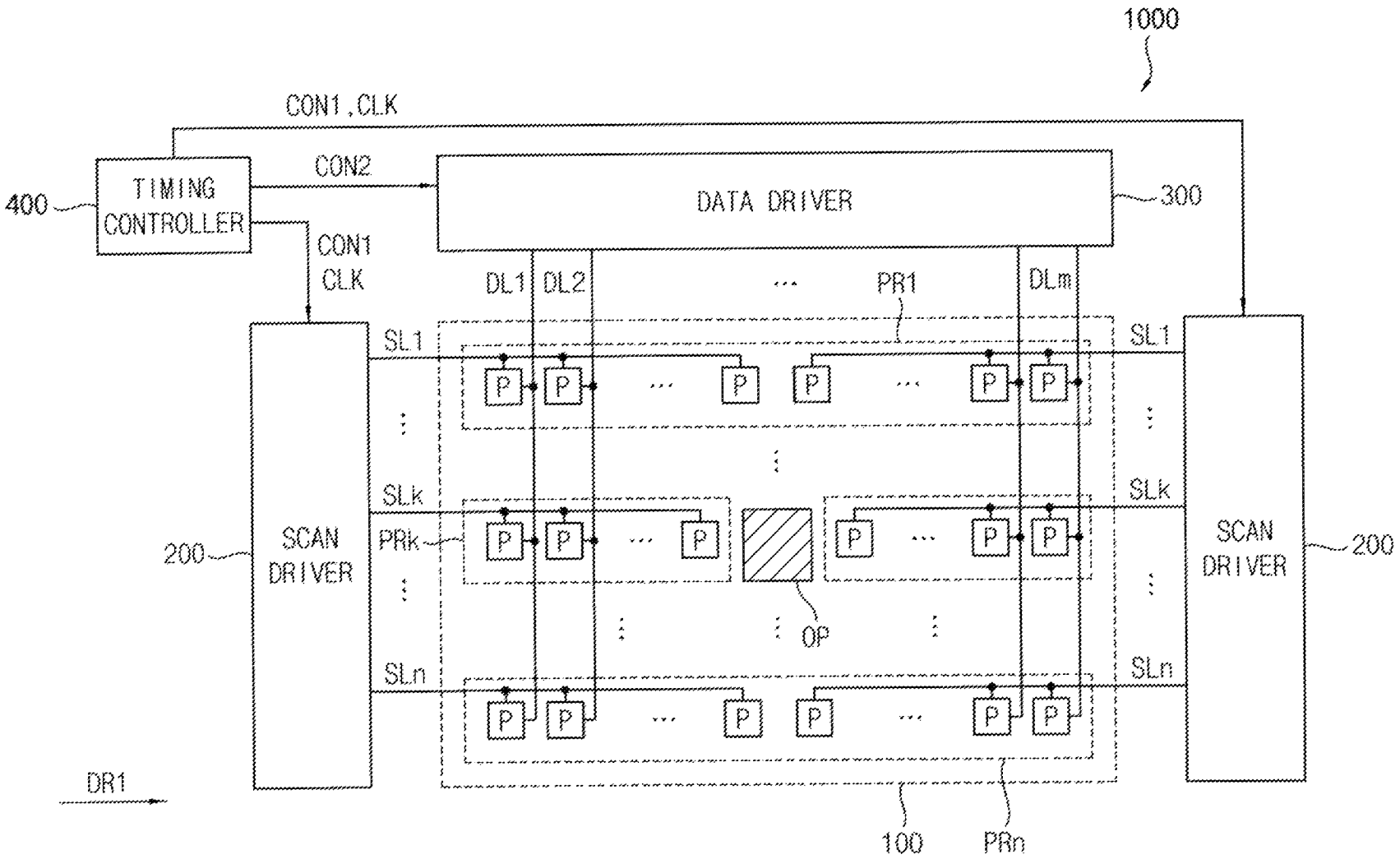
FIG. 1 is a block diagram of a display device according to example embodiments.
Figure 2:
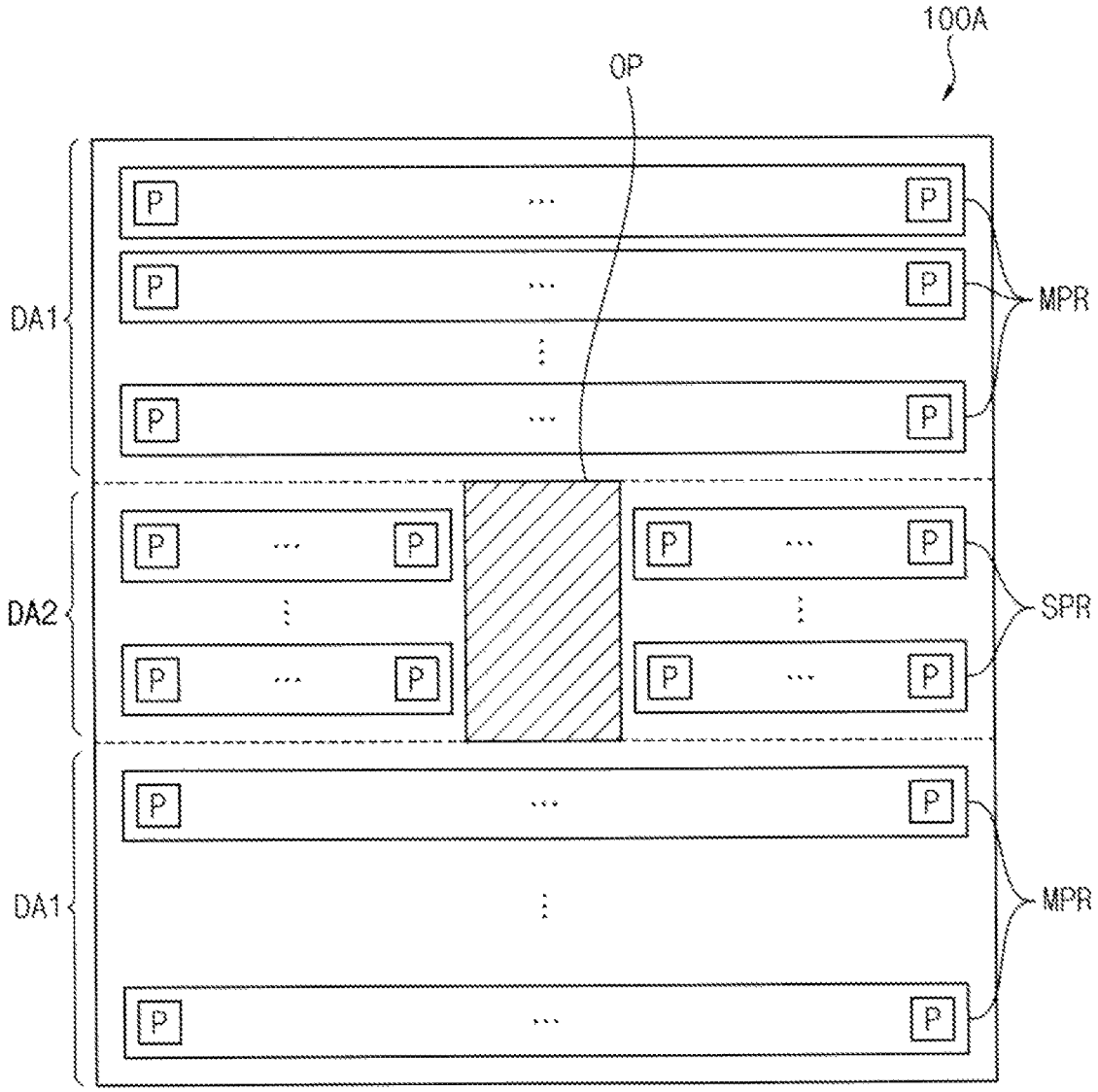
FIG. 2 is a diagram illustrating an example of a display panel included in the display device of FIG. 1.

FIG. 1 is a block diagram of a display device 1000 according to example embodiments. FIG. 2 is a diagram illustrating an example of a display panel 100A included in the display device 1000 of FIG. 1.

Referring to FIGS. 1 and 2, the display device 1000 may include a display panel 100 (the display panel 100 of FIG. 1 may, for example, be the display panel 100A of FIG. 2), a scan driver 200, a data driver 300, and a timing controller 400. In some embodiments, the display device 1000 may further include an emission control driver for generating an emission control signal to control an emission of pixels P.

In some embodiments, the display device 1000 may be an organic light emitting display device.

The display panel 100 may display images. The display panel 100 may include a plurality of scan lines SL1 through SLn and a plurality of data lines DL1 through DLm. The display panel 100 may also include the pixels P connected to the scan lines SL1 through SLn and the data lines DL1 through DLm. For example, the pixels P may be arranged in a matrix form. In some embodiments, the number of scan lines SL1 through SLn may be n, where n is an integer greater than 0. The number of data lines DL1 through DLm may be m, where m is an integer greater than 0. In some embodiments, the number of pixels P may be equal to n×m. Spaces between each of the pixels P in a first direction DR1 may be substantially the same. Here the first direction DR1 may be parallel to a pixel row.

The pixels P may be grouped as a plurality of pixel rows PR1 through PRn corresponding to the scan lines SL1 through SLn, respectively. In some embodiments, the number of pixels P in a portion of the pixel rows PR1 through PRn may be less than the number of pixels P of the others of the pixel rows PR1 through PRn. For example, as illustrated in FIG. 2, first area pixel rows MPR in a first area DA1 may have the same number of pixels P. The number of pixels P of each of the second area pixel rows SPR in a second area DA2 may be less than the number of pixels P of each of the first area pixel rows MPR.

In some embodiments, the second area DA2 of the display panel 100 may include an opening pattern OP in which the pixels P are not located. The second area pixel rows SPR may overlap the opening pattern OP. In other words, the second area pixel rows SPR may be adjacent to left and right side of the opening pattern OP. Thus, the number of pixels P of each of the second area pixel rows SPR may be less than the number of pixels P of each of the first area pixel rows MPR. That is, lengths of the second area pixel rows SPR may be less than lengths of the first area pixel rows MPR. Accordingly, loads (or resistance components) of the scan lines connected to the second area pixel rows SPR may be less than load of the scan lines connected to the first area pixel rows MPR.

In some embodiments, pixels, data lines, scan lines, and other lines may be not located in the opening pattern OP. In some embodiments, the lines (e.g., data lines, scan lines, and other lines) except for the pixels may be located in the opening pattern OP. In some embodiments, other elements of an electronic device included in the display device 1000 may be disposed in the opening pattern OP. For example, a camera, a lens, various sensors, and/or the like may be disposed in the opening pattern OP. Input/output elements such as a speaker, a microphone, a joystick, a track ball, and the like may be disposed in the opening pattern OP.

The opening pattern OP may have various shapes. For example, the opening pattern OP may have square, round, oval, ring, 'S', 'U' shapes, and/or the like, and be at any location of the display panel 100. The display panel 100 may have a plurality of opening patterns OP.

The display panel 100 may have various shapes. For example, the display panel 100 may have a square shape, a square having one clipped corner, a round shape, a hexagonal shape, and the like and each of the lengths of the pixel rows PR1 through PRn may be determined according to the shape of the display panel 100.

The scan driver 200 may include a plurality of stages connected to the respective scan lines SL1 through SLn that are respectively connected to the first area pixel rows MPR and the second area pixel rows SPR. The stages may be connected in series to each other. The scan driver 200 may provide a plurality of scan signals having substantially the same width of active period to the first area pixel rows MPR and the second area pixel rows SPR based on a first control signal CON1 and a pulse width of a clock signal CLK received from the timing controller 400. In some embodiments, the scan signals may be sequentially provided to the pixel rows PR1 through PRn. The lengths of the pixel rows PR1 through PRn and/or the loads connected to the respective scan lines SL1 through SLn may be different according to the first area DA1 and the second area DA2. Thus, time differences of rising times/falling times of the scan signals with respect to the first area DA1 and the second area DA2 may occur, turn-on times of switching transistors in each of the stages may be different between the first area DA1 and the second area DA2. The scan driver 200 may receive the clock signal CLK having adjustable pulse width from the timing controller 400 based on the length of each of the pixel row (or the number of pixels in each pixel row, or the load of each pixel row). The scan driver 200 may adjust turn-on time of the switching transistors in each of the stages based on the clock signal CLK.

In some embodiments, the scan driver 200 may be disposed at both sides of the display panel 100. In this case, the scan lines may not pass through the opening pattern OP. Accordingly, the scan lines may not be disposed in the opening pattern OP. In some embodiments, the scan driver 200 may be disposed at one side of the display panel 100. In this case, a portion of the scan lines may be connected the pixels P in the second area DA2 by passing through the opening pattern OP.

The data driver 300 may convert a data signal received from the controller 400 into a data voltage (e.g., an analog data voltage) based on a second control signal CON2 received from the controller 400. The data driver 300 may output the data voltage to the data lines DL1 through DLm.

The timing controller 400 may control the scan driver 200 and the data driver 300. The timing controller 400 may receive an input control signal and an input image signal from an image source, such as an external graphic apparatus. The timing controller 400 may generate the first control signal CON1 for controlling a driving timing of the scan driver 200 and may generate the second control signal CON2 for controlling a driving timing of the data driver 300, based on the input control signal. The timing controller 400 may output the first and second control signals CON1 and CON2 to the scan driver 200 and the data driver 300, respectively.

The timing controller 400 may adjust the width of the active period of the clock signal CLK within a frame period based on locations of the first area DA1 and the second area DA2. The width of the active period of the scan signal may be determined by the width of the active period of the clock signal CLK. In some embodiments, the timing controller 400 may adjust the width of active period of the clock signal CLK based on the first area pixel rows MPR and the second area pixel rows SPR. The width of the active period of the clock signal CLK corresponding to a period that the scan signals are provided to the second area pixel rows SPR may be less than the width of the active period of the clock CLK signal corresponding to a period that the scan signals are provided to the first area pixel rows MPR. Since the load of each of the second area pixel rows SPR is less than first area pixel rows MPR, rising/falling times of output signals of the stages corresponding to the second area DA2 (hereinafter, represented as second area stages) may be shorter than rising/falling times of output signals of the stages corresponding to the first area DA1 (hereinafter, represented as first area stages). Accordingly, the timing controller 200 may decrease the width of the active period of the clock signal CLK applied to the second area stages, such that data writing times with respect to the all pixels P included in the first area pixel rows MPR and the second are pixel rows SPR can be substantially the same as each other.

In some embodiments, the timing controller 400 may adjust the width of the active period of the clock signal CLK corresponding to the second area pixel rows SPR based on the number of pixels P of each of the second area pixel rows SPR. The width of the active period of the clock signal CLK corresponding to a first pixel row of the second area pixel row SPR may be less than the width of the active period of the clock signal CLK corresponding to a second pixel row of the second area pixel row SPR, when the number of pixels P of the first pixel row is less than the number of pixels P of the second pixel row.

As described above, the display device 1000 according to example embodiments may include the display panel 100 and 100A having the opening pattern OP of various shapes and the pixel rows PR1 through PRn having various lengths, and adjust the width of the active period of the clock signal CLK provided to the scan driver 200 according to the lengths of the pixel rows PR1 through PRn (e.g., the number of pixels P of each of the pixel rows PR1 through PRn). Accordingly, the plurality of scan signals having substantially the width of the active period may be output to the display panel 100 regardless of the shape of the display panel 100 and the lengths of the pixel rows PR1 through PRn. Thus, the data writing times for the pixels P may be substantially uniform and data writing time uniformity and luminance uniformity may be improved.

Figure 3:
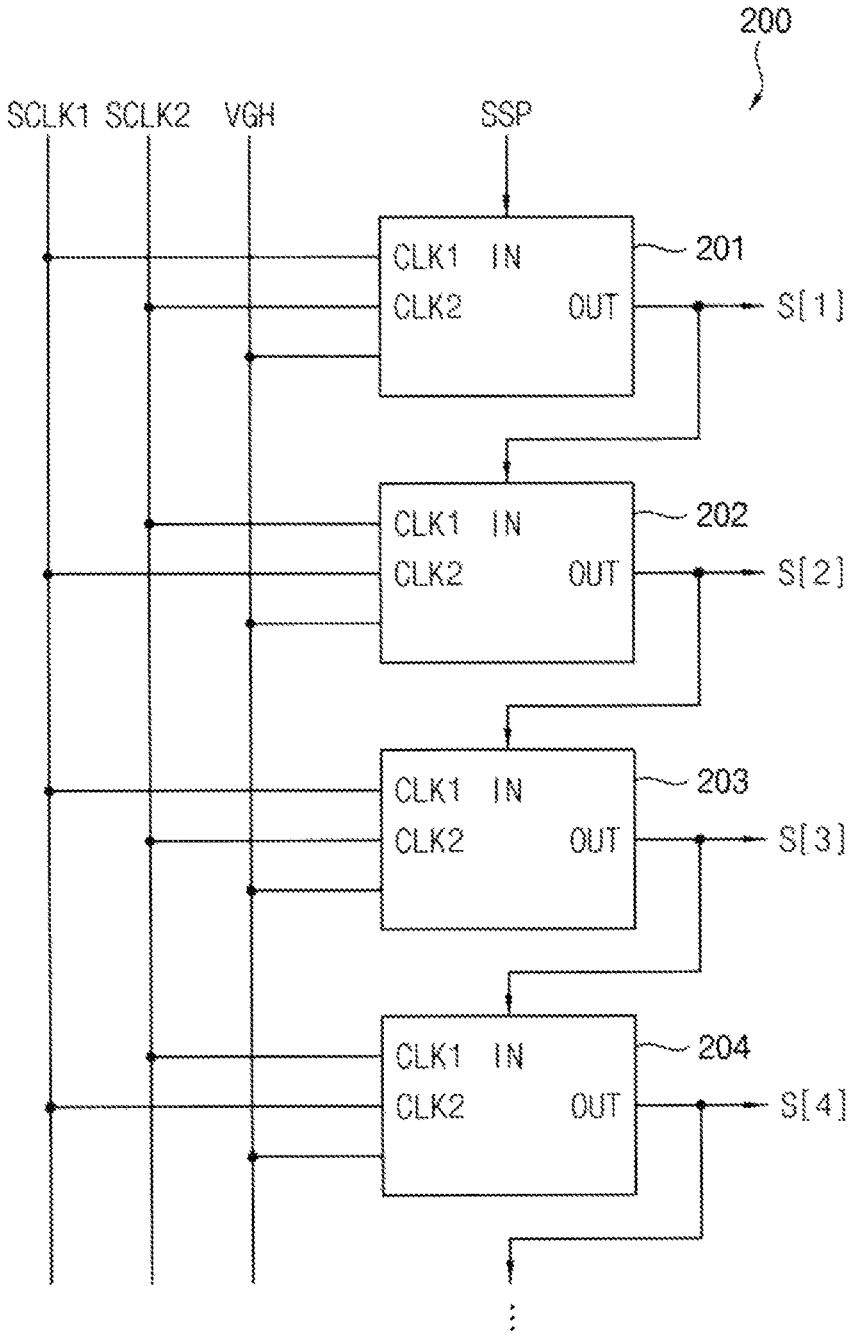
FIG. 3 is a block diagram illustrating an example of a scan driver included in the display device of FIG. 1.

FIG. 3 is a block diagram illustrating an example of the scan driver 200 included in the display device 1000 of FIG. 1.

Referring to FIG. 3, the scan driver 200 may include a plurality of stages 201, 202, 203, 204, etc. connected to each other.

The stages 201, 202, 203, 204, etc. may be respectively connected to a corresponding one of scan lines. For example, the stages 201, 202, 203, 204, etc. may output a plurality of scan signals S[1], S[2], S[3], etc. via the scan lines, respectively; however, this is an example, and the signals output from the stages 201, 202, 203, 204, etc. are not limited thereto. As another example, each of the signals output from the stages 201, 202, 203, 204, etc. may be emission control signals, sensing signals, initialization signals, etc., according to constructions of transistors in a pixel.

Each of the stages 201, 202, 203, 204, etc. may include a first clock signal input terminal CLK1, a second clock signal input terminal CLK2, an input signal input terminal IN, and an output terminal OUT. A first clock signal SCLK1 may be input to the first clock signal input terminal CLK1 of each of the odd stages 201, 203, etc., and a second clock signal SCLK2 may be input to the second clock signal input terminal CLK2 of each of the odd stages 201, 203, etc. The first clock signal SCLK1 may be input to the second clock signal input terminal CLK2 of each of the even stages 202, 204, etc., and the second clock signal SCLK2 may be input to the first clock signal input terminal CLK1 of each of the even stages 202, 204, etc.

The stages 201, 202, 203, 204, etc. may sequentially output the scan signals S[1], S[2], S[3], S[4], etc. based on the first clock signal SCLK1, the second clock signal SCLK2, an input signal applied to the input signal input terminal IN, and a power voltage VGH.

The first stage 201 may receive a scan start signal (frame start signal) SSP, sometimes called an input signal, at the input signal terminal IN to generate a first scan signal S[1], and may output the first scan signal S[1] to a first scan line and the input signal input terminal IN of the second stage 202. The k-th stage may output a k-th scan signal generated by (k−1)-th scan signal from the (k−1)-th stage, where k is an integer greater than 1 and less than or equal to n.

Each of the stages 201, 202, 203, 204, etc. may receive the clock signals SCLK1 and SCLK2 having width of an active period determined based on a length of corresponding pixel row (i.e., a load of corresponding pixel row).

Figure 4:
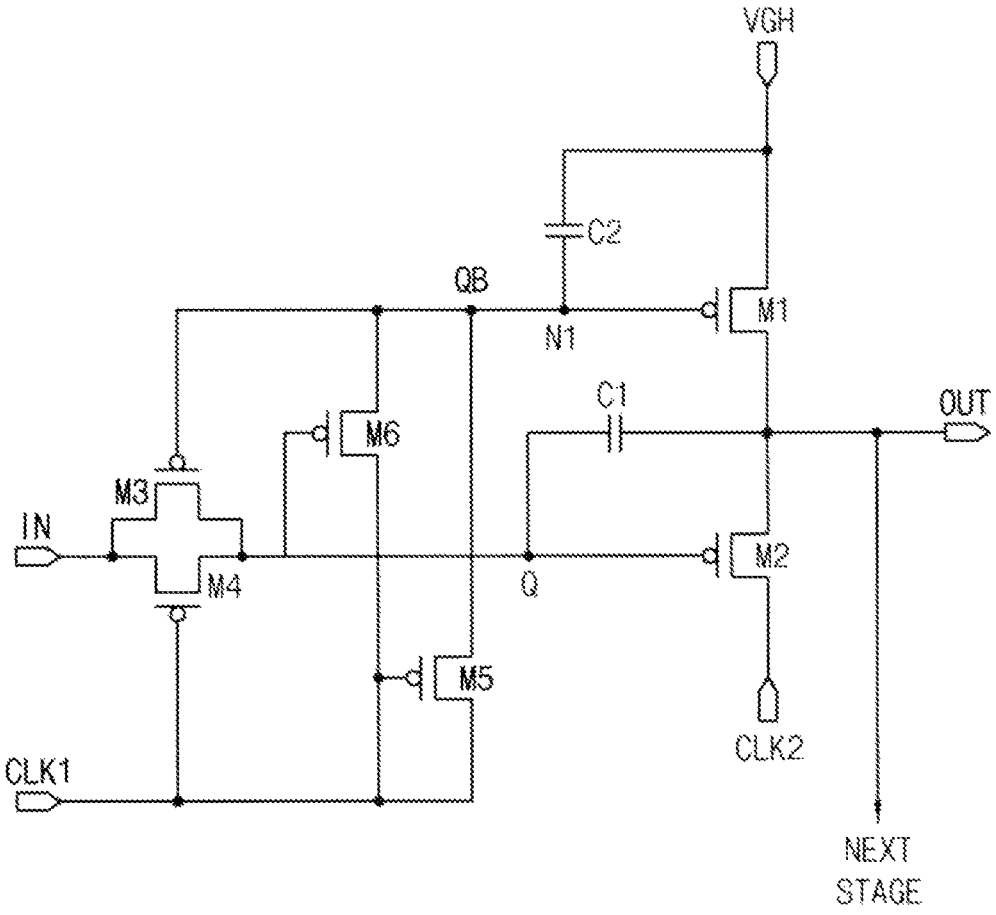
FIG. 4 is a circuit diagram illustrating an example of a stage included in the scan driver of FIG. 3.

FIG. 4 is a circuit diagram illustrating an example of a stage included in the scan driver of FIG. 3.

Referring to FIG. 4, the stage may include first through sixth transistors M1 through M6, and first and second capacitors C1 and C2.

According to one or more embodiments, p-channel metal-oxide semiconductor (PMOS) transistors may be used as one or more of the transistors M1 through M6. For example, the signals applied to gate electrodes of the PMOS transistors may be activated with a logical low level. However, the inventive concept is not limited thereto, and some of the transistors may be implemented with n-channel metal-oxide semiconductor (NMOS) transistors, and the signals applied to the gate electrodes of the NMOS transistors may be activated with a logical high level.

The first transistor M1 may include a gate electrode connected to a first node QB, a first electrode connected to a power voltage VGH, and a second electrode connected to an output terminal OUT. The second transistor M2 may include a gate electrode connected to a second node Q, a first electrode connected to a second clock signal input terminal CLK2, and a second electrode connected to the output terminal OUT. The third transistor M3 may include a gate electrode connected to the first node QB, a first electrode connected to an input signal input terminal IN, and a second electrode connected to the second node Q. The fourth transistor M4 may include a gate electrode connected to a first clock signal input terminal CLK1, a first electrode connected to the input signal input terminal IN, and a second electrode connected to the second node Q. The fifth transistor M5 may include a gate electrode connected to the first clock signal input terminal CLK1, a first electrode connected to the first clock signal input terminal CLK1, and a second electrode connected to the first node QB. The sixth transistor M6 may include a gate electrode connected to the second node Q, a first electrode connected to the first clock signal input terminal CLK1, and a second electrode connected to the first node QB. The first capacitor C1 may include a first electrode connected to the second node Q, and a second electrode connected to the output terminal OUT. The second capacitor C2 may include a first electrode connected to the first node QB, and a second electrode connected to the first power voltage VGH. Here, the power voltage VGH may have a voltage level corresponding to a logical high level (i.e., a turn-off voltage, an inactivation voltage.

The stage may output a scan signal based on an output from a previous stage (or a scan start signal), the first clock signal, and the second clock signal. In some embodiments, an active level (i.e., a turn-on voltage, or a logical low level) of the scan signal output from the output terminal OUT may be output synchronized with an active level (or an active period) of a clock signal applied to the second clock signal input terminal CLK2 by the second transistor M2. Thus, the width of active period of the scan signal may be determined depending on the width of active period of the clock signal applied to the second clock signal input terminal CLK2.

Figure 5:
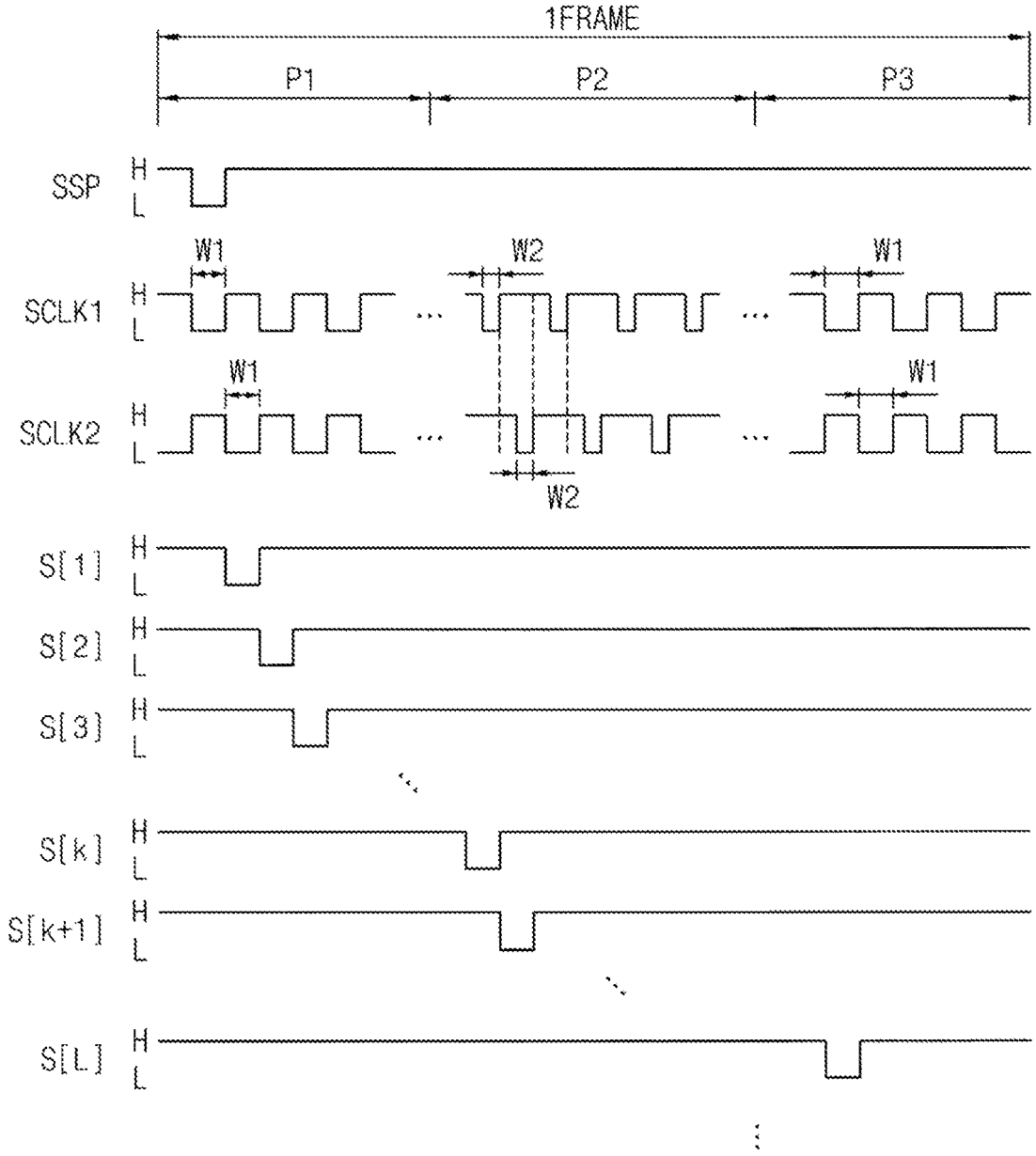
FIG. 5 is a timing diagram illustrating an example of an operation of the scan driver of FIG. 3.

FIG. 5 is a timing diagram illustrating an example of an operation of the scan driver of FIG. 3.

Referring to FIGS. 1 through 5, the scan driver 200 may sequentially output a plurality of scan signals S[1], S[2], etc. during a frame period 1FRAME. A first period P1 and a third period P3 may correspond to periods that the scan signals are provide to the first area DA1 of the display panel, and the second period P2 may correspond to a period that the scan signals are provided to a second area DA2 of the display panel.

The fourth and fifth transistors M4 and M5 of the first stage 201 may be turned on and the first clock signal SCLK1 having an active level (i.e., a logical low level) L and the active level L of the first clock signal SCLK1 may be transferred to the first node QB when the scan start signal SSP and the first clock signal SCLK1 both having the active level L are applied to the first stage 201. The first and third transistors M1 and M3 may be turned on by the active level L at the first node QB and the active level of the scan start signal SSP may be applied to the second node Q. Then, the second transistor M2 may be turned on by the active level L at the second node Q and an inactive level H of the second clock signal SCLK2 may be transferred to the output terminal OUT. Here, the first capacitor C1 may be charged by a voltage of the inactive level H of the output terminal OUT and a voltage of the active level L of the second node Q.

Then, the scan start signal SSP and the first clock signal SCLK1 may change into the inactive level H and the first clock signal SCLK1 may change into the active level L. Thus, the first scan signal S[1] may change into the inactive level H and the active level L of the second scan signal S[2]

may be output. Accordingly, all scan signals maybe sequentially output during the frame period 1FRAME.

In some embodiments, the width of active period the first and second clock signals SCLK1 and SCLK2 corresponding to the first period P1 (hereinafter, represented as a first width W1) may be substantially the same as the width of active period the first and second clock signals SCLK1 and SCLK2 corresponding to the third period P3. Since the numbers of pixels of each of the first area pixel rows MPR in the first area DA1 may be the same, loads of output lines (e.g., the scan lines) respectively corresponding to the first area pixel rows MPR may be substantially the same. For example, the first width W1 may be substantially the same as a single horizontal period 1H.

The scan signals may be provided to the second area pixel rows SPR in the second area DA2 for the second period P2. The widths of active periods of the first and second clock signals SCLK1 and SCLK2 during the second period P2 may have a second width W2. As illustrated in FIG. 2, since the numbers of each of the second area pixel rows SPR are the same, the widths of active periods of the first and second clock signals SCLK1 and SCLK2 may be substantially the same during the second period P2.

Since the loads of the second area pixel rows SPR are less than the first area pixel rows MPR, the second width W2 may be shorter than the first width W1. Thus, the scan driver 200 may output the scan signals having substantially the same width of active period to each other.

Accordingly, data writing times with respect to the all pixels P may be substantially the same, and luminance of the entire display panel having the opening pattern OP may be substantially uniform.

The scan signals may be provided to a portion of the first area DA1 during the third period P3 which is lower than the portion of the first area DA1 to which scan signals are provided during the first period P1, and the widths of the active periods of the first and second clock signals SCLK1 and SCLK2 may have the first width W1 again during the third period P3.

As described above, the widths of the active periods (i.e., W1 and W2) of the first and second clock signals SCLK1 and SCLK2 may be adjusted based on the lengths of the pixel rows (i.e., the number of the pixel row, or the load of the pixel row) such that the width of the active period of entire scan signals may be substantially uniform. Thus, the data writing times with respect to the all pixels P may be substantially the same.

Figure 6:
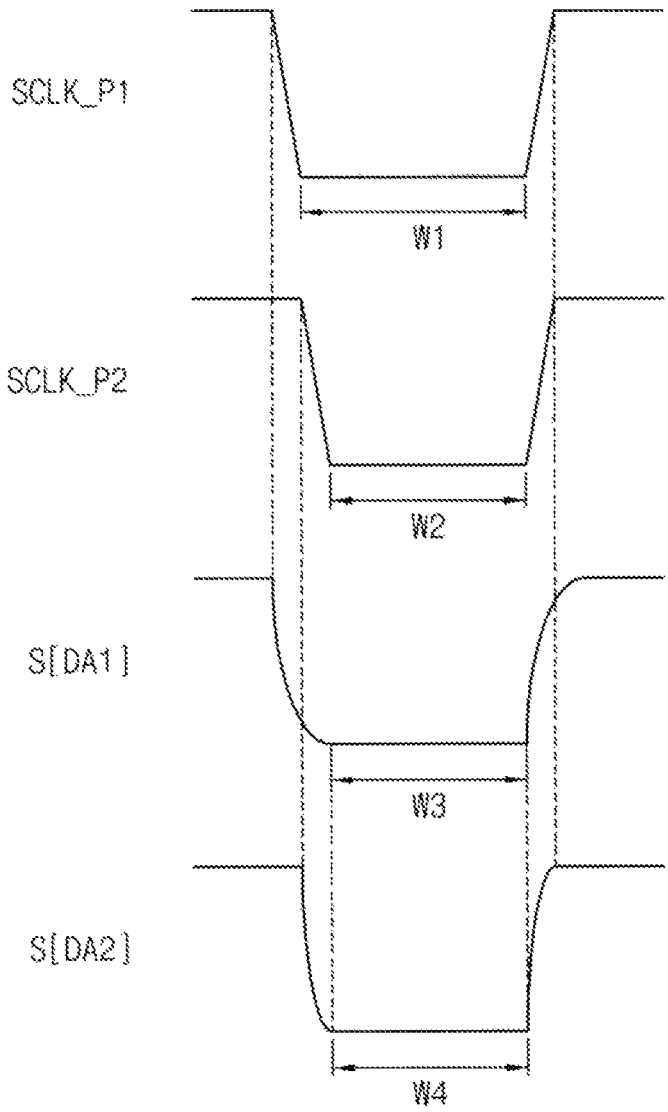
FIG. 6 is an enlarged view of a portion of the timing diagram of FIG. 5.

FIG. 6 is an enlarged view of a portion of the timing diagram of FIG. 5.

Referring to FIGS. 5 and 6, the first width W1 that is a width of a clock signal SCLK_P1 for the first period P1 may be different from the second width W2 that is a width of a clock signal SCLK_P2 for the second period P2.

Since the loads of the second area pixel rows SPR are less than the first area pixel rows MPR, rising/falling times of output signals of the second area stages may be shorter than rising/falling times of output signals of the first area stages.

In some embodiments, the second width W2 may be shorter than the first width W1. Since the loads of the second area pixel rows SPR corresponding to the second period P2 are less than the first area pixel rows MPR corresponding to the first period P1, the second width W2 may be adjusted to be shorter than the first width W1. Thus, the width W3 of the active period of the scan signal S[DA1] corresponding to the first area DA1 may be substantially the same as the width W4 of the active period of the scan signal S[DA2] corresponding to the second area DA2.

Thus, in the display panel having the opening pattern OP, data writing times with respect to the all pixels P may be substantially the same, and luminance of the entire display panel may be substantially uniform.

Figure 7A:
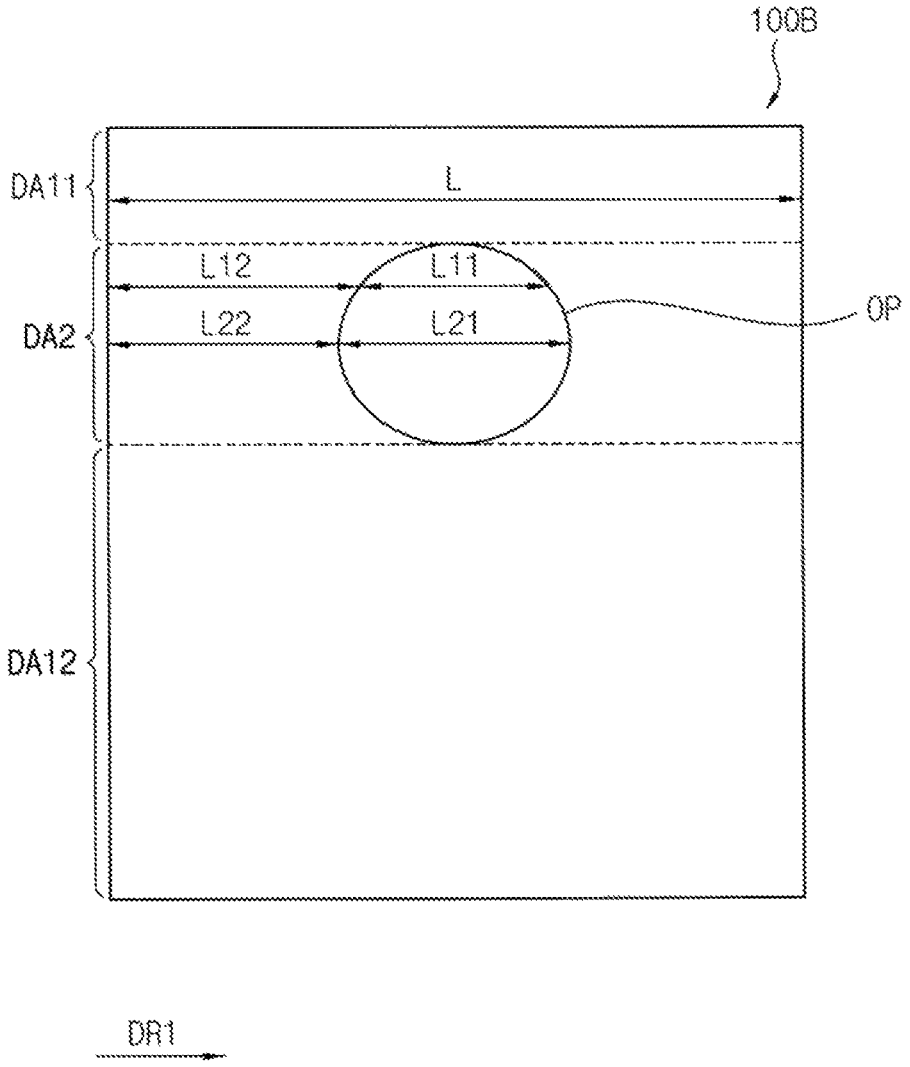
FIG. 7A is a diagram illustrating an example of a display panel included in the display device of FIG. 1.
Figure 7B:
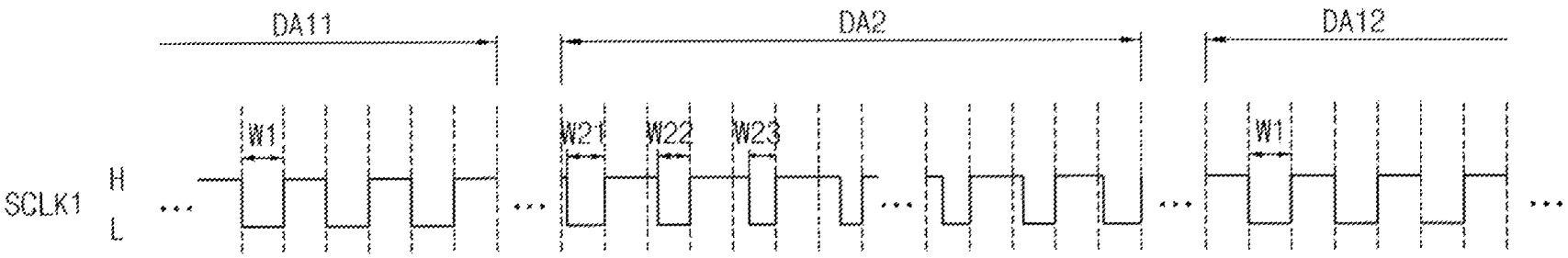
FIG. 7B is a timing diagram illustrating an example of a clock signal output for driving the display panel of FIG. 7A within a frame period.

FIG. 7A is a diagram illustrating an example of a display panel 100B included in the display device 1000 of FIG. 1. FIG. 7B is a timing diagram illustrating an example of a clock signal output for driving the display panel of FIG. 7A within a frame period.

Referring to FIGS. 7A and 7B, the display panel 100B may include a first area DA11 and DA12 and a second area DA2.

In some embodiments, as illustrated in FIG. 7A, a round shape opening pattern OP may be in the second area DA2. Accordingly, lengths of the opening pattern OP L11 and L21 in the first direction DR1 may not be uniform, and thus lengths of the second area pixel rows L12 and L22 may not be uniform. Since the lengths of the second area pixel rows L12 and L22 are shorter than the lengths of the first area pixel rows L, the load of the second area DA2 may be less than the first area DA1. In some embodiments, the lengths of the second area pixel rows L12 and L22 may be shorter and the number of each of the second area pixel rows may decrease, when the of the opening pattern OP L11 and L21 increases.

As illustrated in FIG. 7B, the timing controller 400 may adjust a width of an active period of a clock signal SCLK1 in a frame period, based on the length of the pixel row (i.e., a load of the pixel row).

The width W1 of the active period of the clock signal SCLK1 corresponding to the first area DA11 and DA12 may be substantially uniform. The widths W21, W22, and W23 of the active period of the clock signal SCLK1 corresponding to the second area DA2 may be shorter than the width W1 of the active period of the clock signal SCLK1 corresponding to the first area DA11 and DA12.

In some embodiments, the timing controller 400 may adjust the width of the active period of the clock signal SCLK1 corresponding to the second area DA2 as W21, W22, and W23 based on change of the length of the second area pixel row L12, L22, etc. In some embodiments, the shorter the length of the pixel row in the second area DA2, the shorter (narrower) the width of the active period of the clock signal SCLK1 (illustrated as W21, W22, and W23 in FIG. 7B). Thus, the width of the active period of the clock signal SCLK1 may change such as W21, W22, W23 in FIG. 7B according to the length of the second area pixel row L12, L22, etc. when the scan signal output with respect to the second area DA2 is going on.

In some embodiments, a camera, a lens, various sensors, and/or the like may be disposed in the opening pattern OP. Input/output elements such as a speaker, a microphone, a joystick, a track ball, and the like may be disposed in the opening pattern OP.

Figure 8A:
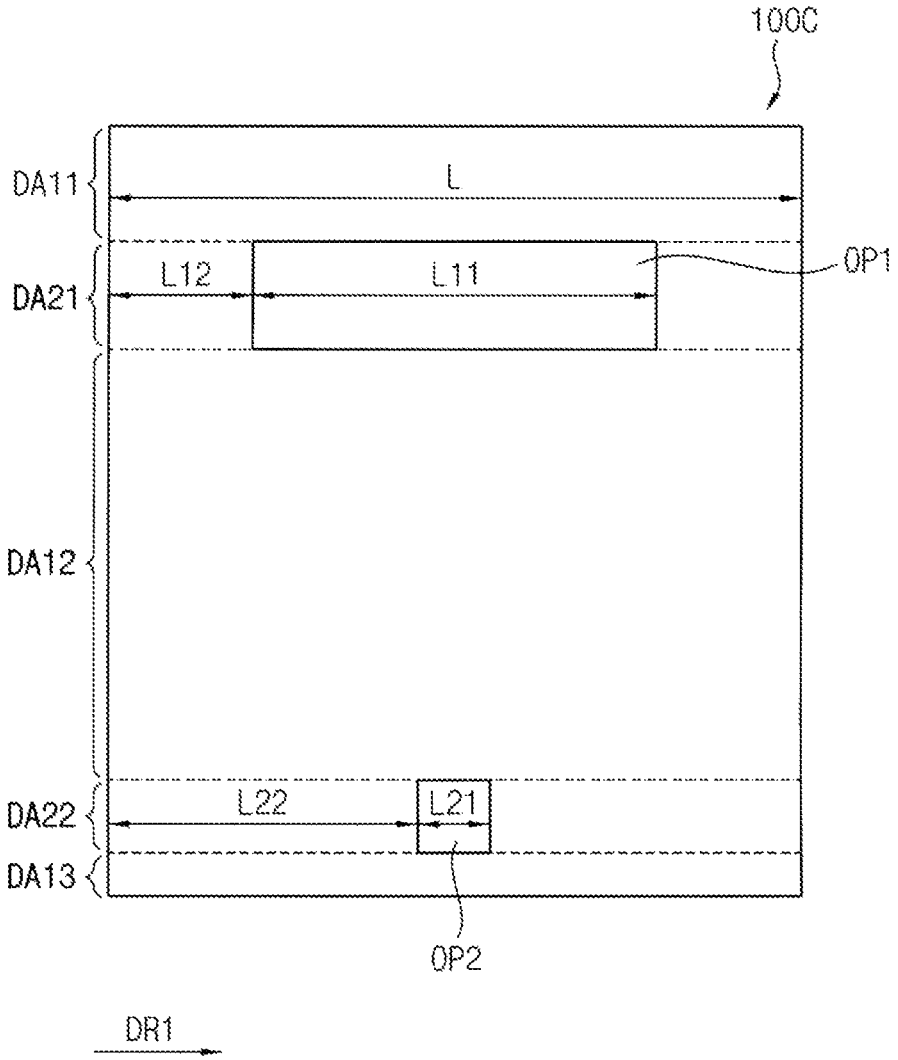
FIG. 8A is a diagram illustrating another example of a display panel included in the display device of FIG. 1.
Figure 8B:
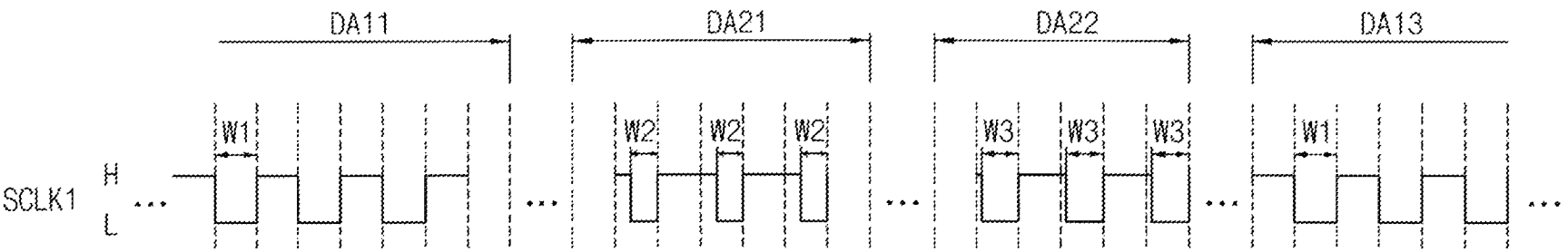
FIG. 8B is a timing diagram illustrating an example of a clock signal output for driving the display panel of FIG. 8A within a frame period.

FIG. 8A is a diagram illustrating another example of a display panel 100C included in the display device 1000 of FIG. 1. FIG. 8B is a timing diagram illustrating an example of a clock signal output for driving the display panel 100C of FIG. 8A within a frame period.

Referring to FIGS. 8A and 8B, the display panel 100C may include a first area DA11, DA12, and DA13 and a second area DA21 and DA22.

In some embodiments, as illustrated in FIG. 8A, the display panel 100C may include a plurality of opening patterns OP1 and OP2. For example, a first opening pattern OP1 may have a first length L11 and a second opening pattern OP2 may have a second length L21 different from the first length L11. Thus, a length L12 of pixel rows in the second area DA21 having the first opening pattern OP1 may be shorter than a length L22 of pixel rows in the second area DA22 having the second opening pattern OP2.

As illustrated in FIG. 8B, the timing controller may adjust a width of an active period of a clock signal SCLK1 in a frame period, based on the length of the pixel row (i.e., a load of the pixel row).

The width W1 of the active period of the clock signal SCLK1 corresponding to the first area DA11, DA12, and DA13 may be substantially uniform.

The width W2 of the active period of the clock signal SCLK1 corresponding to the second area DA21 having the first opening pattern OP1 may be substantially uniform.

The width W3 of the active period of the clock signal SCLK1 corresponding to the second area DA22 having the second opening pattern OP2 may be substantially uniform.

However, since the first length L11 is longer than the second length L21, the width W2 of the active period of the clock signal SCLK1 corresponding to the second area DA21 having the first opening pattern OP1 may be shorter than the width W3 of the active period of the clock signal SCLK1 corresponding to the second area DA22 having the second opening pattern OP2.

In some embodiments, a camera, a lens, various sensors, and/or the like may be disposed in the opening patterns OP1 and/or OP2. Input/output elements such as a speaker, a microphone, a joystick, a track ball, and the like may be disposed in the opening pattern OP and/or OP2.

Figure 9:
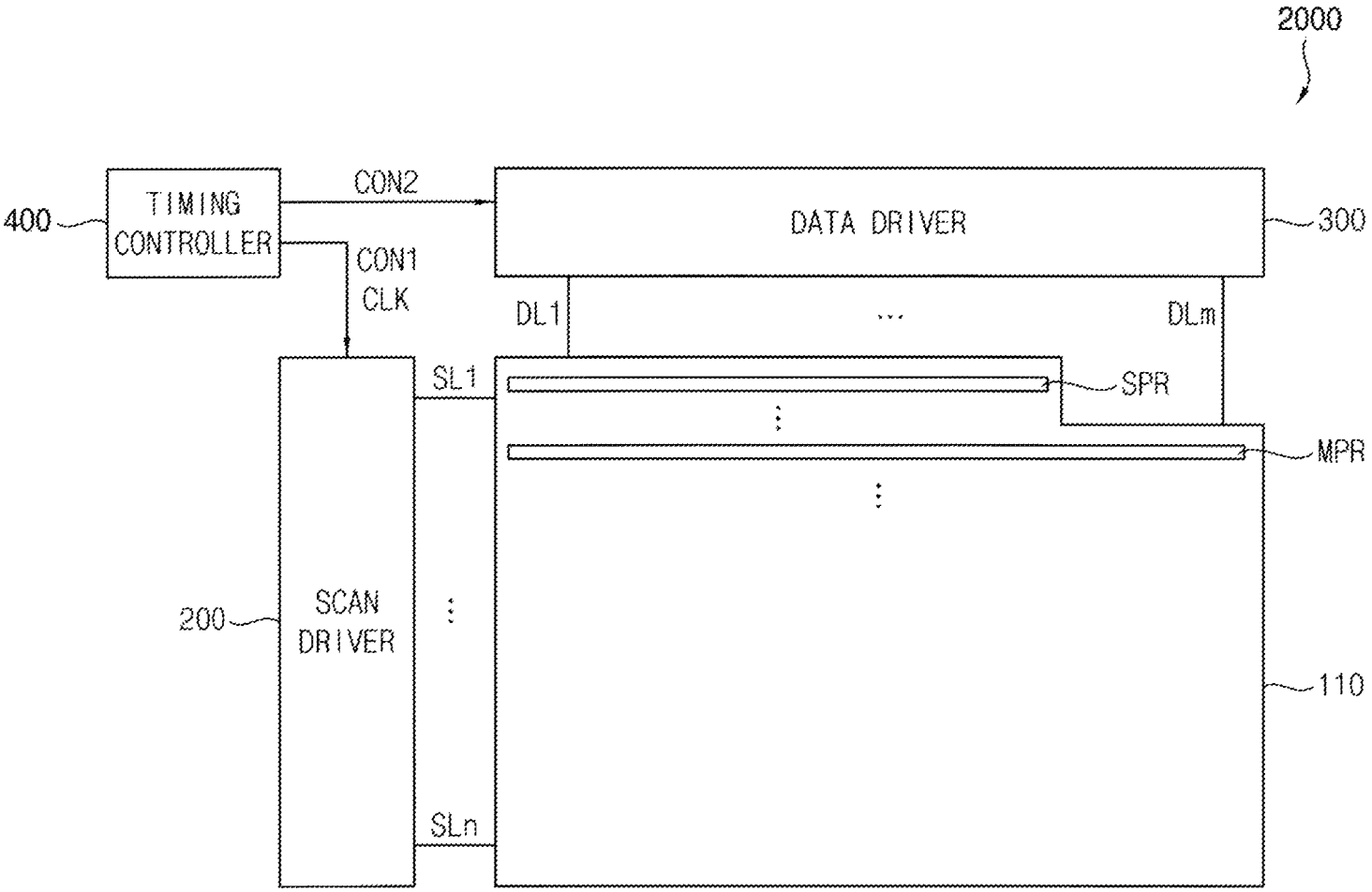
FIG. 9 is a block diagram of a display device according to example embodiments.

FIG. 9 is a block diagram of a display device 2000 according to example embodiments.

In FIG. 9, like reference numerals are used to designate elements of the display device 2000 the same as those in FIGS. 1 and 2, and detailed description of these elements may be omitted. The display device 2000 of FIG. 9 may be substantially the same as or similar to the display device 1000 of FIGS. 1 and 2 except for a display panel 110.

Referring to FIG. 9, the display device 2000 may include the display panel 110, a scan driver 200, a data driver 300, and a timing controller 400. In some embodiments, the display device 2000 may further include an emission control driver for generating an emission control signal to control an emission of pixels P.

The display panel 110 may display images. The display panel 110 may include a plurality of scan lines SL1 through SLn and a plurality of data lines DL1 through DLm. The display panel 110 may also include the pixels P connected to the scan lines SL1 through SLn and the data lines DL1 through DLm. The display panel 110 may have various shapes (e.g., various notch shapes). For example, the display panel 110 may have a square having one clipped corner, a round shape, a hexagonal shape, a trigonal shape and the like.

The pixels P may be grouped as a plurality of pixel rows SPR and MPR. A length of each of the pixel rows SPR and MPR may be determined according to the shape of the display panel 110. For example, as illustrated in FIG. 9, the display panel 110 may have a notch shape having one clipped corner. Here, lengths of the pixel rows SPR in the second area DA2 (e.g., see FIGS. 10A and/or 10B) including the clipped corner may be less than lengths of the pixel rows MPR in the first area DA1. In some embodiments, the number of each of the pixel rows SPR in the second area DA2 may be less than the number of each of the pixel rows MPR in the first area DA1 (e.g., see FIGS. 10A and/or 10B).

In some embodiments, the second area DA2 of the display panel 110 may include an opening pattern in which the pixels P are not located. The opening pattern may have various shapes. For example, the opening pattern may have square, round, oval, ring, 'S', IF shapes, and/or the like, and be at any location of the display panel 110. The display panel 110 may have a plurality of opening patterns. In some embodiments, other elements of an electronic device included in the display device 2000 may be disposed in the opening pattern. For example, a camera, a lens, various sensors, and/or the like may be disposed in the opening pattern. Input/output elements such as a speaker, a microphone, a joystick, a track ball, and the like may be disposed in the opening pattern.

The scan driver 200 may include a plurality of stages connected to the respective scan lines SL1 through SLn that are connected to the pixel rows MPR and SPR. The stages may be connected in series to each other. The scan driver 200 may provide a plurality of scan signals having substantially the same width of active period to the pixel rows MPR and SPR based on a first control signal CON1 and a width of an active period of a clock signal CLK received from the timing controller 400. In some embodiments, the scan signals may be sequentially provided to the pixel rows.

The data driver 300 may convert a data signal received from the controller 400 into a data voltage (e.g., an analog data voltage) based on a second control signal CON2 received from the controller 400. The data driver 300 may output the data voltage to the data lines DL1 through DLm.

The timing controller 400 may control the scan driver 200 and the data driver 300. The timing controller 400 may adjust the width of the active period of the clock signal within a frame period based on locations of the first area DA1 and the second area DA2. The width of the active period of the scan signal may be determined by the width of the active period of the clock signal. In some embodiments, the timing controller 400 may adjust the width of active period of the clock signal based on the pixel rows MPR and SPR. The width of active period of the clock signal may be reduced when the length of the pixel row decreases. In some embodiments, the timing controller 400 may adjust the width of the active period of the clock signal based on the number of pixels of each of the pixel rows MPR and SPR. For example, the less the number of the pixels in a pixel row, the shorter (the narrower) the width of the active period of the clock signal.

As described above, the display device 2000 according to example embodiments may include the display panel 110 having various shapes including various lengths of pixel rows SPR and MPR, and adjust the width of the active period of the clock signal provided to the scan driver 200 according to the lengths of the pixel rows SPR and MPR (e.g., the number of pixels of each of the pixel rows SPR and MPR). Accordingly, the plurality of scan signals having substantially the width of the active period may be output to the display panel 110 regardless of the shape of the display panel 110 and the lengths of the pixel rows MPR and SPR. Thus, the data writing times for the pixels may be substantially uniform and data writing time uniformity and luminance uniformity may be improved.

Figure 10A:
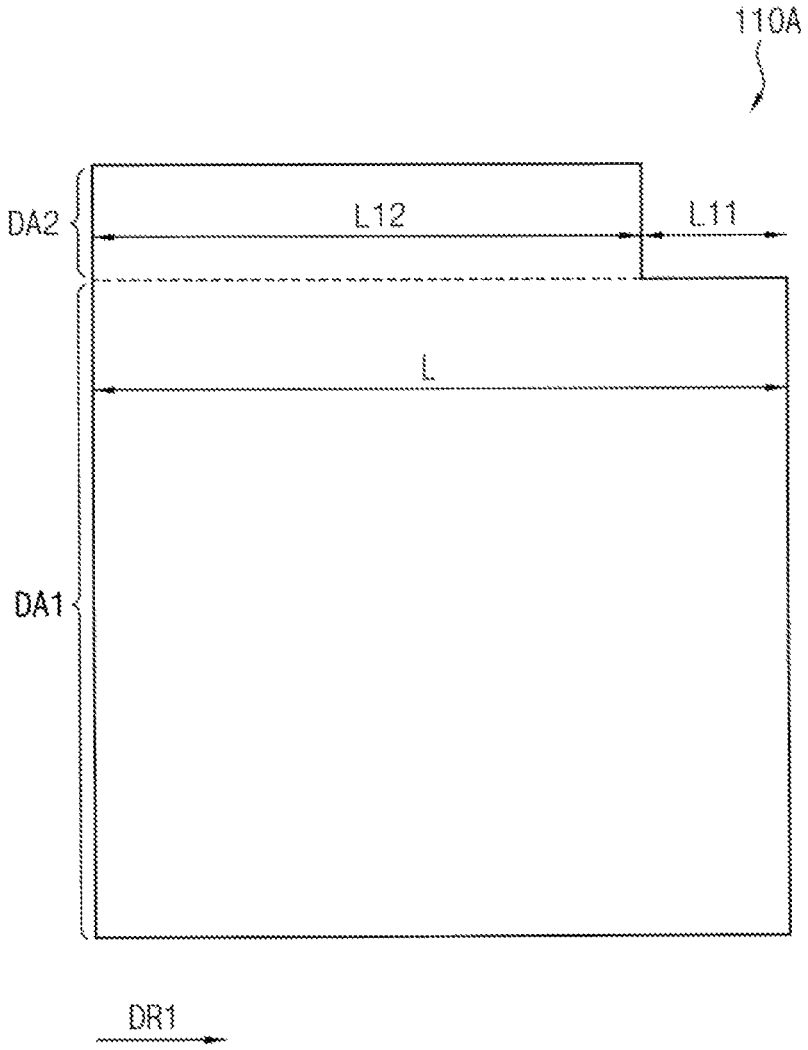
FIG. 10A is a diagram illustrating an example of a display panel included in the display device of FIG. 9.
Figure 10B:
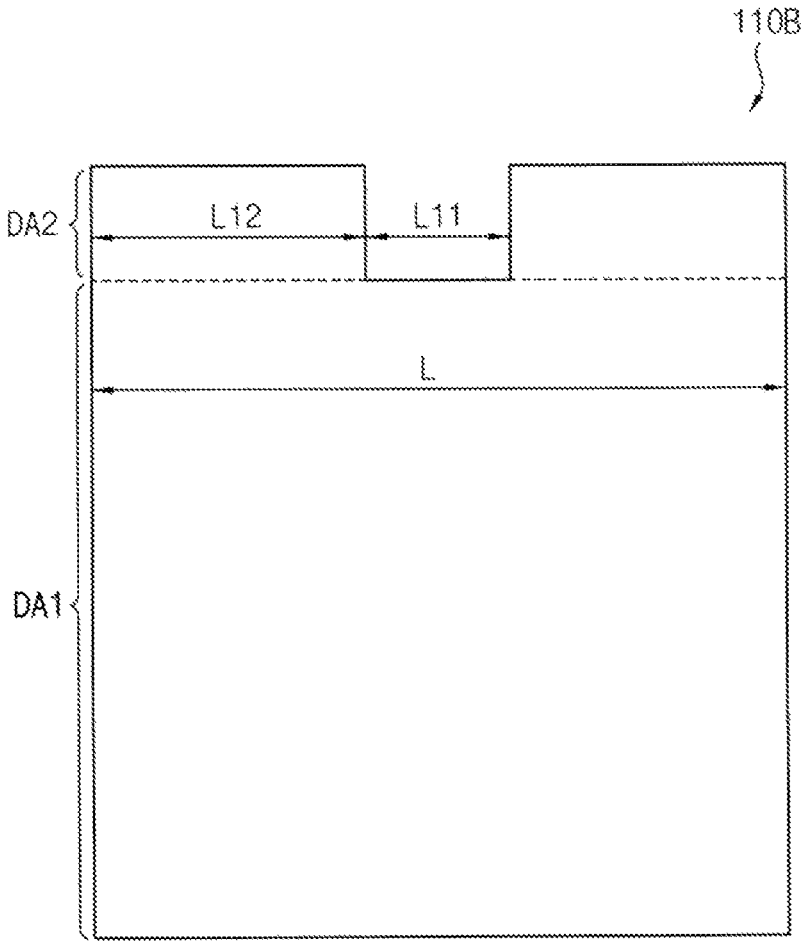
FIG. 10B is a diagram illustrating another example of a display panel included in the display device of FIG. 9.
Figure 10C:
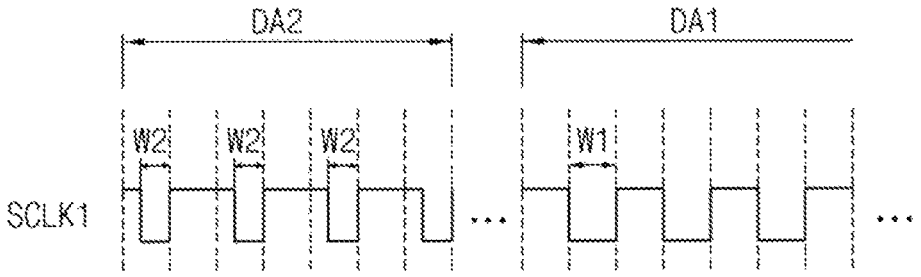
FIG. 10C is a timing diagram illustrating an example of a clock signal output for driving the display panel of FIG. 10A or FIG. 10B.

FIG. 10A is a diagram illustrating an example of a display panel 110A included in the display device 2000 of FIG. 9. FIG. 10B is a diagram illustrating another example of a display panel 100B included in the display device 2000 of FIG. 9. FIG. 10C is a timing diagram illustrating an example of a clock signal output for driving the display panel of FIG. 10A or FIG. 10B.

Referring to FIGS. 10A through 10C, the display panel 110A may include a first area DA1 and a second area DA2.

In some embodiments, as illustrated in FIG. 10A, a length L12 of the second area DA2 in a first direction DR1 may be shorter than a length L of the first area DA1 in the first direction DR1. Thus, a length of each of pixel rows in the second area DA2 may be shorter than a length of each of pixel rows in the first area DA1, and thus, loads of the second area DA2 (i.e., each load corresponding to the pixel rows in the second area) may be less than loads of the first area DA1 (i.e., each load corresponding to the pixel rows in the first area).

As illustrated in FIG. 10B, a portion without pixels may be located in a center portion of the second area DA2 of the display panel 110B. Since constructions of the display panel 110B and operations of the clock signal SCLK1 of FIG. 10B are similar to or substantially the same as the constructions and operations of the display panel 110A of FIG. 10A, duplicated descriptions are omitted.

As illustrated in FIG. 10C, the timing controller 400 may adjust a width of an active period of a clock signal SCLK1 in a frame period, based on the length of the pixel row (i.e., a load of the pixel row).

The width W1 of the active period of the clock signal SCLK1 corresponding to the first area DA1 may be substantially uniform.

The width W2 of the active period of the clock signal SCLK1 corresponding to the second area DA2 may be substantially uniform. Since length L12 of the second area DA2 is less than the length L of the first area DA1, the width W2 of the active period of the clock signal SCLK1 corresponding to the second area DA2 may be determined to be shorter than the width W1 of the active period of the clock signal SCLK1 corresponding to the first area DA1.

Figure 11A:
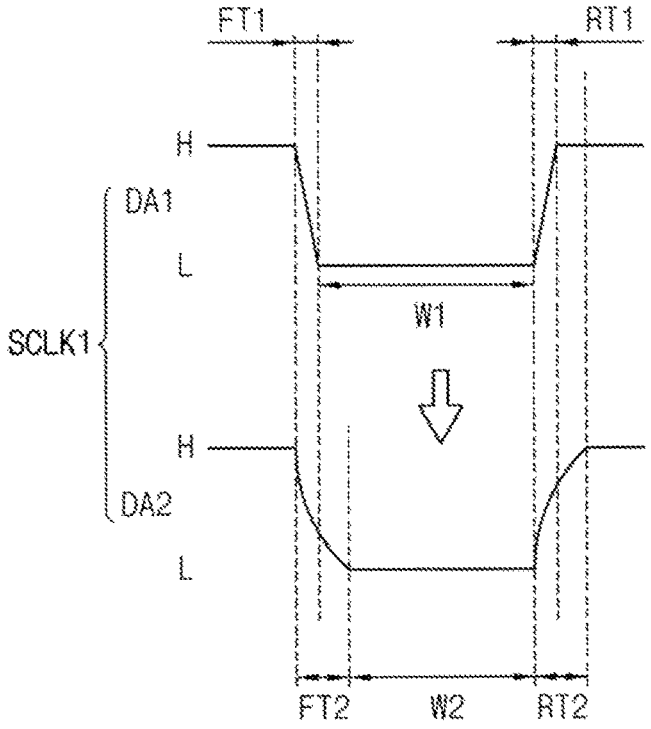
FIG. 11A is a timing diagram illustrating an example of a clock signal of FIG. 10C.
Figure 11B:
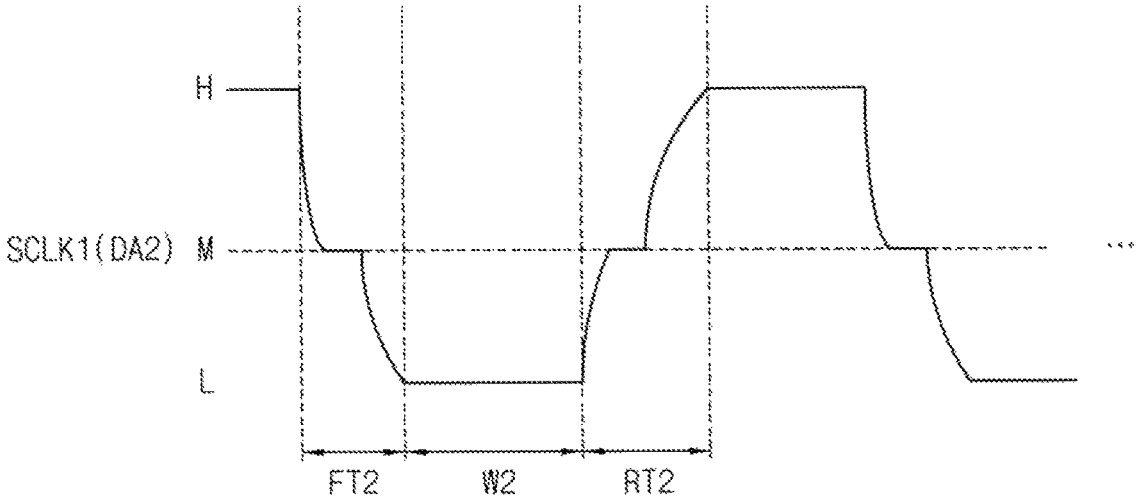
FIG. 11B is a timing diagram illustrating an example for implementing the clock signal of FIG. 11A.

FIG. 11A is a timing diagram illustrating an example of a clock signal of FIG. 10C. FIG. 11B is a timing diagram illustrating an example for implementing the clock signal of FIG. 11A.

Referring to FIGS. 10C and 11B, the timing controller 400 may adjust a width of an active period of a clock signal SCLK1 in a frame period, based on the length of the pixel row (i.e., a load of the pixel row).

FIGS. 11A and 11B shows an example of an enlarged view of a portion of the clock signal SCLK1 of FIG. 10C. In some embodiments, transition times of the clock signal SCLK1 corresponding to a period that the scan signals are provided to the second area DA2 may be determined to be longer than transition times of the clock signal SCLK1 corresponding to a period that the scan signals are provided to the first area DA1. Accordingly, a first falling time FT1 of the clock signal SCLK1 corresponding to the first area DA1 may be shorter than a second falling time FT2 of the clock signal SCLK1 corresponding to the second area DA2. In some embodiments, a first rising time RT1 of the clock signal SCLK1 corresponding to the first area DA1 may be shorter than a second rising time RT2 of the clock signal SCLK1 corresponding to the second area DA2. In some embodiments, a timing controller may control the falling times and/or rising times of the clock signal SCLK1. For example, lengths of the falling times and/or rising times of the clock signal SCLK1 may be controlled based on a change of a frequency of a dot clock applied to the timing controller. In some embodiments, the timing controller may control start points of the falling times and/or rising times of the clock signal SCLK1 based on the number of clocks of the dot clock such that the lengths of the falling times and/or rising times of the clock signal SCLK1 may be adjusted.

As a result, the width W2 of the active period of the clock signal SCLK1 corresponding to the second area DA2 may be shorter than the width W1 of the active period of the clock signal SCLK1 corresponding to the first area DA1. Accordingly, data writing times for the pixels may be substantially uniform and luminance uniformity of the display panel having the opening pattern (or the notch) may be improved. Further, luminance difference may be compensated more precisely by controlling the lengths of the falling times and/or rising times of the clock signal SCLK1.

FIG. 11B shows an example of increasing the rising time RT2 and the falling time FT2 of the clock signal SCLK1. In some embodiments, the clock signal may increase by a step in the second rising time RT2 to increase the length of the second rising time RT2 and decrease by a step in the second falling time FT2 to increase the length of the second falling time FT2. A predetermined intermediate voltage M may be determined between a logical high level H (e.g., an inactive level) and a logical low level L (e.g., an active level). The transition of the clock signal SCLK1 may pass the intermediate voltage M. For example, the intermediate voltage M may be determined as a ground voltage when the logical high level H is about 7V and the logical low level is about −8V. In some embodiments, the transition of the clock signal SCLK1 may be generated by a charge sharing method. Also, the frequency of the dot clock or the control start points of the falling time and/or rising time of the clock signal SCLK1 may be controlled to adjust the control start points of the falling times and/or rising times of the clock signal SCLK1.

Accordingly, data writing times for the pixels may be substantially uniform and luminance uniformity of the display panel having the opening pattern (or the notch) may be improved. Further, luminance difference may be compensated more precisely by controlling the lengths of the falling times and/or rising times of the clock signal SCLK1.

Figure 12A:
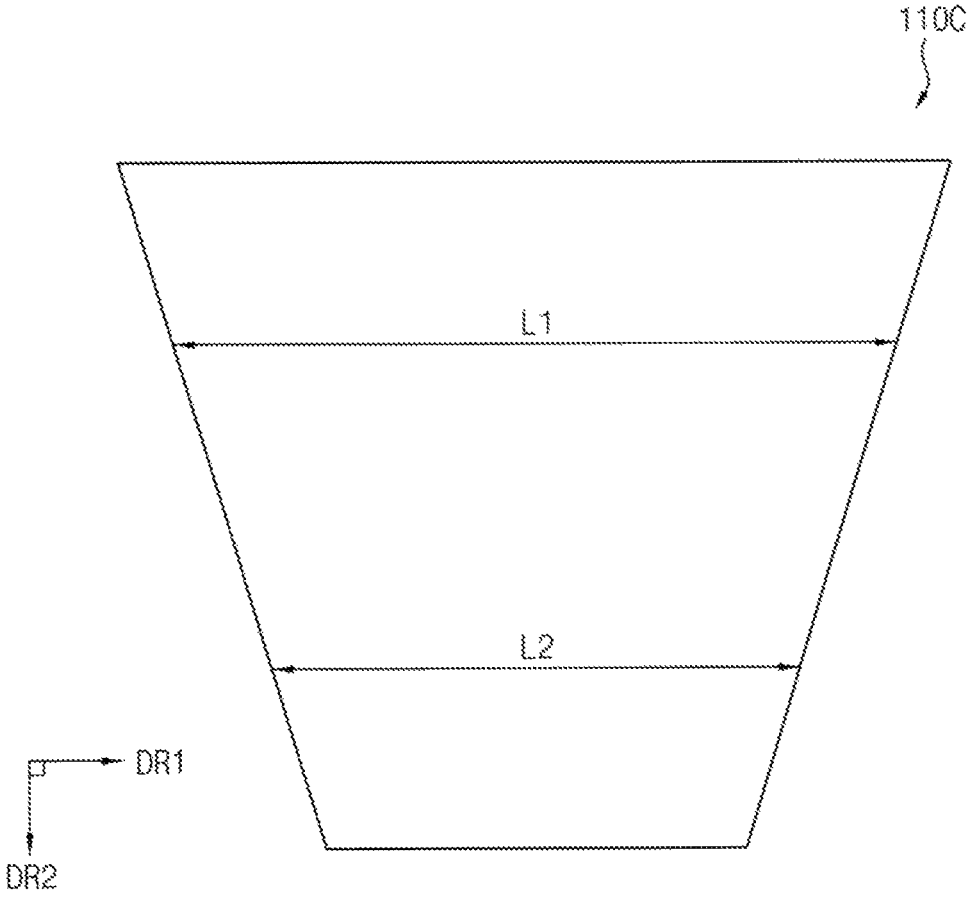
FIG. 12A is a diagram illustrating still another example of a display panel included in the display device of FIG. 9.
Figure 12B:
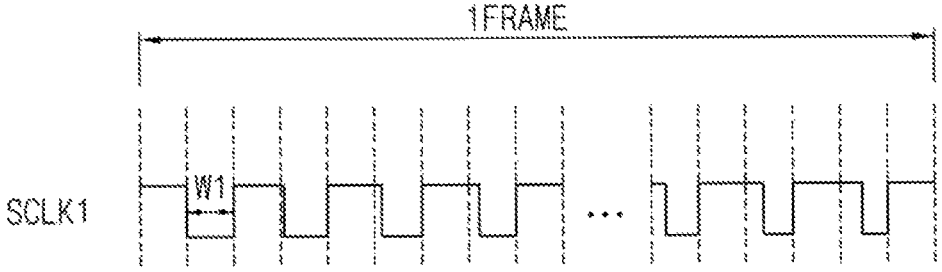
FIG. 12B is a timing diagram illustrating an example of a clock signal output for driving the display panel of FIG. 12A within a frame period.

FIG. 12A is a diagram illustrating still another example of a display panel 110C included in the display device 2000 of FIG. 9. FIG. 12B is a timing diagram illustrating an example of a clock signal output for driving the display panel 110C of FIG. 12A within a frame period.

Referring to FIGS. 12A and 12B, the display panel 110C may have a trapezoidal shape. A length (expressed as L1 and L2) in a first direction DR1 of the display panel 110C may be shortened toward a second direction DR2. Thus, the load of a pixel row may be reduced toward the second direction DR2.

As illustrated in FIG. 12B, the timing controller 400 may adjust a width W1 of an active period of a clock signal SCLK1 within a frame period 1FRAME based on a length of the pixel row (i.e., the load of the pixel row). For example, the width W1 of the active period of the clock signal SCLK1 applied to the scan driver may be reduced gradually according to a scan operation. Accordingly, an effective time of the scan operation (i.e., data writing operation) with respect to the all pixel rows may be substantially the same regardless of the shape of the display panel, the difference of panel load, the length of the pixel row, and the like.

Figure 13A:
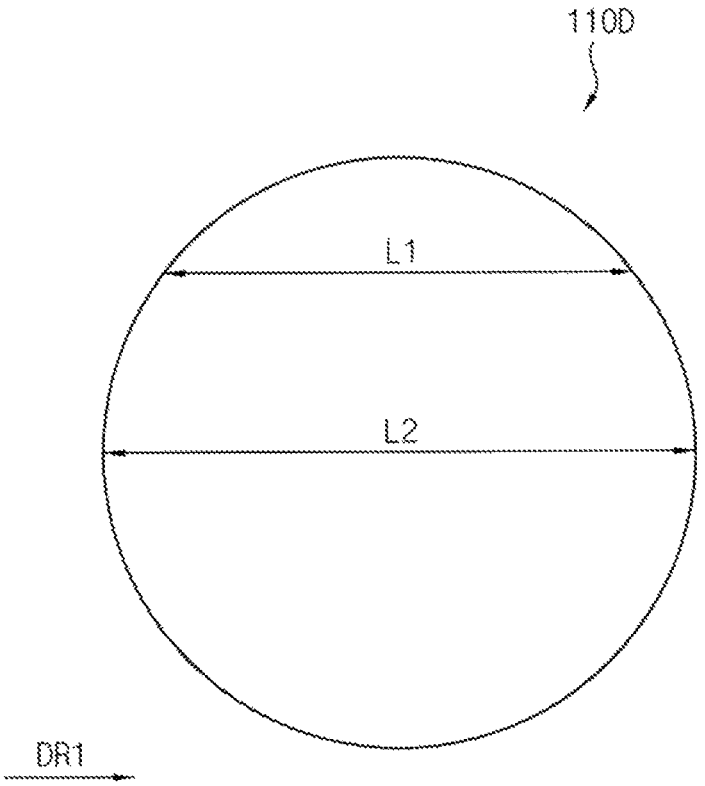
FIG. 13A is a diagram illustrating further still another example of a display panel included in the display device of FIG. 9.
Figure 13B:
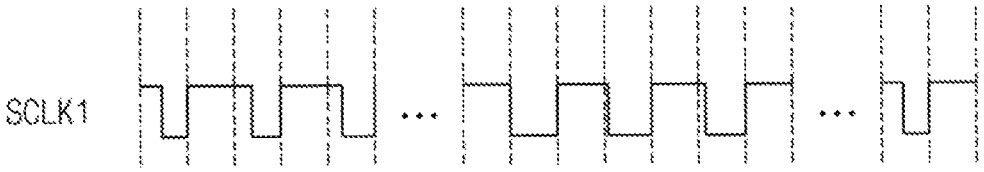
FIG. 13B is a timing diagram illustrating an example of a clock signal output for driving the display panel of FIG. 13A within a frame period.

FIG. 13A is a diagram illustrating further still another example of a display panel 110D included in the display device 2000 of FIG. 9. FIG. 13B is a timing diagram illustrating an example of a clock signal output for driving the display panel 110D of FIG. 13A within a frame period.

Referring to FIGS. 13A and 13B, the display panel 110D may be a round shape. Thus, a length of the display panel 110D in a first direction DR1 (i.e., expressed as L1 and L2) may not be uniform. As illustrated in FIG. 12B, the timing controller 400 may adjust a width of an active period of a clock signal SCLK1 within a frame period 1FRAME based on a length of the pixel row (i.e., the load of the pixel row).

For example, the width of the active period of the clock signal SCLK1 applied to the scan driver may be gradually increased and gradually reduced again according to a scan operation. Accordingly, an effective time of the scan operation (i.e., data writing operation) with respect to the all pixel rows may be substantially the same regardless of the shape of the display panel, the difference of panel load, the length of the pixel row, and the like.

The present embodiments may be applied to any display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and features of example embodiments. Accordingly, all such modifications are intended to be included within the scope of example embodiments as defined in the claims. In the claims, any means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display device, comprising:

a display panel divided into a first area including a plurality of first area pixel rows and a second area including a plurality of second area pixel rows, the number of pixels of each of the second area pixel rows being less than the number of pixels of each of the first area pixel rows;

a scan driver configured to provide a plurality of scan signals to the first area pixel rows and the second area pixel rows based on a width of an active period of a clock signal, the scan signals being output having substantially the same width of active periods to each other;

a data driver configured to provide a plurality of data signals to the display panel via a plurality of data lines; and a timing controller configured to adjust the width of the active period of the clock signal within a frame period based on locations of the first area and the second area.

2. The display device of claim 1, wherein the timing controller adjusts the width of the active period of the clock signal based on the first area pixel rows and the second area pixel rows, and wherein the width of the active period of the clock signal corresponding to a period that the scan signals are provided to the second area pixel rows is less than the width of the active period of the clock signal corresponding to a period that the scan signals are provided to the first area pixel rows.

3. The display device of claim 2, wherein the timing controller adjusts the width of the active period of the clock signal based on locations of the first area pixel rows and the second area pixel rows such that the widths of the active periods of the scan signals are substantially the same as each other.

4. The display device of claim 2, wherein the number of pixels of at least one of the second area pixel rows is different from the others of the second area pixel rows.

5. The display device of claim 4, wherein the timing controller adjusts the width of the active period of the clock signal based on the number of pixels of each of the second area pixel rows.

6. The display device of claim 4, wherein the width of the active period of the clock signal corresponding to a first pixel row of the second area pixel rows is less than the width of the active period of the clock signal corresponding to a second pixel row of the second area pixel rows, when the number of pixels of the first pixel row is less than the number of pixels of the second pixel row.

7. The display device of claim 2, wherein the numbers of the pixels of the second area pixel rows are the same as each other.

8. The display device of claim 7, wherein the width of the active period of the clock signal is uniform while the scan signals are provided to the second area pixel rows.

9. The display device of claim 2, wherein the second area of the display panel includes an opening pattern in which the pixels are not located.

10. The display device of claim 9, wherein a length of the opening pattern in a first direction is substantially uniform, the first direction being substantially parallel to the second area pixel rows.

11. The display device of claim 10, wherein the numbers of the pixels of the respective second area pixel rows are the same as each other.

12. The display device of claim 10, wherein the width of the active period of the clock signal is uniform while the scan signals are provided to the second area pixel rows.

13. The display device of claim 9, wherein the timing controller adjusts the width of the active period of the clock signal based on a change of a length of the opening pattern in a first direction while the scan signals are provided to the second area pixel rows, when the length of the opening pattern in the first direction is not uniform, the first direction being substantially parallel to the second area pixel rows.

14. The display device of claim 13, wherein the width of the active period of the clock signal decreases when the length of the opening pattern in the first direction increases.

15. The display device of claim 13, wherein the number of pixels of each of the second area pixel rows decreases when the length of the opening pattern in the first direction increases.

16. A display device, comprising:

a display panel including a plurality of pixel rows each having a plurality of pixels;

a scan driver configured to provide a plurality of scan signals to the pixel rows based on a width of an active period of a clock signal, the scan signals being output having substantially the same width of active periods to each other;

a data driver configured to provide a plurality of data signals to the display panel via a plurality of data lines; and a timing controller configured to adjust the width of the active period of the clock signal within a frame period based on lengths of the respective pixel rows.

17. The display device of claim 16, wherein the lengths of the respective pixel rows are determined according to a shape of the display panel.

18. The display device of claim 17, wherein the timing controller shortens the width of the active period of the clock signal according to a decrease of a length of the pixel rows.

19. The display device of claim 16, wherein the timing controller adjusts the width of the active period of the clock signal based on the number of pixels of each of the pixel rows.

20. The display device of claim 16, wherein the display panel includes an opening pattern in which the pixels are not located.

* * * * *